US012036462B1

(12) United States Patent
Wickham et al.

(10) Patent No.: US 12,036,462 B1
(45) Date of Patent: Jul. 16, 2024

(54) GOLF ALIGNMENT AID

(71) Applicant: Pure Swing Technologies LLC, Lafayette, CO (US)

(72) Inventors: Alexander Read Wickham, Lafayette, CO (US); David Thomas Wickham, Lafayette, CO (US)

(73) Assignee: Pure Swing Technologies LLC, Lafayette, CO (US)

( * ) Notice: Subject to any disclaimer, the term of this patent is extended or adjusted under 35 U.S.C. 154(b) by 0 days.

(21) Appl. No.: 17/892,842

(22) Filed: Aug. 22, 2022

Related U.S. Application Data

(60) Provisional application No. 63/237,891, filed on Aug. 27, 2021.

(51) Int. Cl.
*A63B 69/36* (2006.01)
*A63B 71/06* (2006.01)

(52) U.S. Cl.
CPC ..... *A63B 69/3667* (2013.01); *A63B 69/3614* (2013.01); *A63B 71/0622* (2013.01); *A63B 2071/0694* (2013.01); *A63B 2214/00* (2020.08); *A63B 2220/13* (2013.01); *A63B 2220/20* (2013.01); *A63B 2220/805* (2013.01)

(58) Field of Classification Search
CPC ..... A63B 69/3667; A63B 69/3614; A63B 71/0622; A63B 2071/0694; A63B 2214/00; A63B 2220/13; A63B 2220/20; A63B 2220/805
USPC ..... 473/207, 215, 217, 218, 220, 221, 222, 473/409
See application file for complete search history.

(56) References Cited

U.S. PATENT DOCUMENTS

| | | | | |
|---|---|---|---|---|
| 7,228,649 | B2 | 6/2007 | Elliott | |
| 7,892,104 | B2 | 2/2011 | Laden | |
| 8,366,563 | B2 | 2/2013 | Kuhlman | |
| 2005/0153784 | A1* | 7/2005 | Burgin ..... | A63B 69/3667 473/131 |

(Continued)

OTHER PUBLICATIONS

Intel® RealSense™ LiDAR Camera L515 Datasheet, revision 003, Jan. 2021; downloaded from the website www.intelrealsense.com/lidar-camera-I515.

(Continued)

*Primary Examiner* — Nini F Legesse
(74) *Attorney, Agent, or Firm* — Leydig, Voit & Mayer, Ltd.

(57) ABSTRACT

A golf alignment device for use in adjustment of golf stance and golf swing and used to train a user to properly position his/her feet (stance) and the golf club (aim, ball and club head position) when hitting a golf shot. The device includes components for measurement of distance and orientation, including the position of the shoes with respect to each other, the position and/or orientation of the golf club head of the golf club being held by the user and position of the golf ball intended to be struck by the user relative to the device. The alignment device allows determination of the aim of the user as determined by the position of his/her feet as well as the orientation of the golf club head face. A method is also provided for measurement of and adjustment of a golfer's stance and golf swing. This method can be employed in training a golfer and during golf practice.

17 Claims, 8 Drawing Sheets

(56) References Cited

U.S. PATENT DOCUMENTS

| | | | | |
|---|---|---|---|---|
| 2006/0040757 | A1* | 2/2006 | Rosselli | A63B 69/3608 473/218 |
| 2006/0122001 | A1* | 6/2006 | Gaddy | A63B 69/3667 473/220 |
| 2007/0224583 | A1* | 9/2007 | Humphrey | A63B 71/06 434/252 |
| 2008/0032809 | A1 | 2/2008 | Korejwa | |
| 2009/0143157 | A1* | 6/2009 | Ross, Jr. | A63B 69/3608 473/409 |
| 2016/0346660 | A1 | 12/2016 | Johnson | |

OTHER PUBLICATIONS

Intel® RealSenseTM Product Family D400 Series Datasheet, revision 011, Aug. 2021 (see revision history); downloaded from the website www.intelrealsense.com/wp-content/uploads /2022/05/Intel-RealSense-D400-Series-Datasheet-Apr. 2022.pdf.

* cited by examiner

GOLF ALIGNMENT AID

CROSS-REFERENCE TO RELATED APPLICATION

This application claims the benefit U.S. Provisional Patent Application No. 63/237,891 filed Aug. 27, 2021, which is hereby incorporated by reference to the extent not inconsistent herewith.

BACKGROUND OF THE INVENTION

A critical part of any golf shot is the position of the golfer's feet in address with respect to the desired direction of the golf target or target line. Additionally, the position of the golf ball with respect to the golfer's feet (normally in shoes) or stance, is critical as well as the position and orientation of the golf club, specifically the club head, with respect to the target line. Generally speaking, the golfer's aim for a particular shot is dictated by a line that is drawn through the front point of each shoe. This is the golfer's stance line. A line that is parallel to the stance line is drawn through the center point of a golf ball positioned for hitting on a tee or on the ground, and this is this golfer's aim line. However, this stance line cannot be seen in real time by the golfer and the position of the golf ball with respect to the golfer's stance as well as the position and orientation of the golf club head are difficult to quantify with only visual inspection. Thus, the golfer must employ specific indirect methods in order to view his/her stance and ensure his/her aim, ball position, and club head position and orientation are correct. In one method used on the practice range to ensure proper aim, the golfer assumes his/her stance and then lays a rod or a golf club down aligned at the tips of his/her shoes and then steps back and observes the alignment of the rod or club with respect to the target line. However, this process is slow and is usually not conveniently done for each shot in the practice session.

In another method, a rod is placed upon the ground in a predetermined alignment and the golfer adjusts his feet such that his stance line is parallel with the rod. This method, however, can be inaccurate and develops reliance upon a visual aid pointing in the direction of the target in order to achieve proper alignment. The use of such visual aids is prohibited in actual play. In addition, in some cases, the golfer may want to adjust his/her stance so that it is not parallel to the target line. Instead the golfer may want to achieve a specific angle in order to make the ball curve one way or the other. Using a rod in front of the feet does not provide an accurate measure of the offset angle.

A number of patents report methods and devices for helping a golfer achieve proper alignment with the target.

Guides can be in the form of an elongated solid material, such as a rod or antenna, and those that project a light on the ground. Numerous patents of this type have been issued. For example, U.S. Pat. No. 8,366,563 B2 (John Kuhlman 2013) reports a portable, expandable golf training device that is placed on the ground to provide alignment. The device can supply a plurality of tapes, tubes, or rods to provide alignment both in the direction of play and perpendicular to it or a laser or light source in the device can produce a plurality of light beams. The device is placed on the ground in front of the golfer and between the golfer's feet and the ball. Two lines can project outward perpendicular to the direction of play, and two or four lines can project into and away from the direction of play to provide alignment for the golfer.

U.S. Pat. No. 7,892,104 B2 (Mark Laden 2011) reports a device used for achieving correct stance, ball position and alignment. The device includes a reel, attachable to a first shoe of a golf player, a string or tape, the first end of which is connected to the reel and which is wound/unwound, respectively, onto/from the reel, and a fastener.

US published application 2016/0346660 A1 (William Johnson 2016) reports an alignment training mat for golf that has a permanent target line oriented through the ball placement location and perpendicular to the target line at or offset from the ball placement location and one or more sets of primary and secondary foot placement outlines or footprints for various golf shots. The practice mat is described as enabling a golfer to place a ball on the ball placement location and then look along the target line to the shot target. According to the described method, the golfer then decides which golf shot will be required to reach the target from the ball placement location and then stands on the appropriate primary foot placement outline.

US published application 2008/0032809 A1 (Jonstan Korejwa 2008), reports a golf stance laser alignment device to aid a golfer to be more accurately aligned with their intended direction to a target for flight of a golf ball. The alignment device is described to consist of a periscope sighting lens or view-finder attached to a telescope of at least 5× power and a laser generated light line projected on the ground to indicate the accurate foot alignment to an intended target as seen through the sighting telescope. The laser described has a diffraction optical element that converts a laser beam into a planar arc of light which when projected onto a surface such as the ground, produces a laser line which provides the golfer's feet alignment to the target that is sighted through the periscope or view-finder that has been aimed towards a distant target.

An example related to measuring the distance of the golfer's feet, is U.S. Pat. No. 7,228,649 reports a golf alignment system that generates a visible, audible and/or tactile response indicating when a golfer is properly aligned with respect to an intended target line or to a golf ball. Reported embodiments include one where each of the golfer's shoes has at least one transmitter installed on its instep where a receiver is activated by a signal from the transmitter when the first shoe is in predetermined position relative to the second shoe. The activation of the receiver causes an indicator, such as a light emitting device to project a visible reference line on the ground. The patent also reports a way of aligning a golf ball. While the method described provides some information on the position of the feet, it requires sensors to be mounted on one or both shoes and does not provide a continuous display of the golfer's alignment with respect to the target or any information about the location of the golf ball or club head.

While a variety of golf alignment devices have been described in the art, there remains a need in the art for devices which can aid the golfer to properly align his stance.

SUMMARY OF THE DISCLOSURE

The alignment device described herein is used to train someone hitting a golf ball with a golf club to properly position his/her feet (stance) and the golf club, particularly, the golf club head, when hitting a golf shot.

The device and methods herein are useful to improve a golfer's stance, aim, ball position, and club head position (i.e., setup). The device and methods herein are useful for effectively practice hitting a golf ball towards a target. More generally, the device and methods herein are useful for simply practicing the correct mechanics of the golf swing with respect to stance, ball position and club position. The device and methods herein can be used to develop correct stance, aim, ball position and club head position prior to hitting a shot.

The device and method herein allows a user to check their stance, ball position, and/or club head position (i.e., their set up) to ensure they are correct for each practice shot. The device and method herein also allows a user to change their stance, aim, ball position, and/or club head position to adapt them to the type of shot they wish to hit. The device and method herein allows a user to verify and practice stance, aim, ball and club head position. The device and method herein allows a user to adjust or readjust stance, aim, ball and club head position.

The device and method herein allows a user during practice to verify that their set up is correct. After set up verification, if in a practice shot the golf ball goes in the wrong direction, the user then knows that there is another problem, e.g., with their swing motion. The device and method herein can thus allow a user to analyze problems with respect to golf shots and facilitate correction of such problem.

The device allows various useful measurements, for example, the position and/or orientation of the user's shoes, including the position of the shoes with respect to each other, the position and/or orientation of the golf club head of the golf club being held by the user and position of the golf ball intended to be struck by the user relative to the device. By doing this, the alignment device allows, for example, determination, in relation to the user's target, of the aim of the user as determined by the position of his/her feet as well as the orientation of the golf club head face. The device also facilitates determination of the position of the golf ball in relation to the user's feet.

The device which is, in an embodiment, intended for practice purposes is small and easy to set up and use. In an embodiment, the device is portable and does not need to be positioned at a set location, but can be moved to a convenient location. The device is placed, typically directly on the ground, preferably within 30 feet from either of the user's feet. The device's orientation with respect to a selected target, as indicated for example with a target orientation device, determines the device line which is oriented towards the user's target.

The alignment device uses an optical method or an ultrasonic method to determine the position and/or orientation of the user's feet, a golf ball, and golf club from which stance line, aim line, stance distance and ball distance are determined and it relays this information back to the user. In addition, it does not require the use of sensors or transmitters on the user, the shoe, the golf ball or the club head. Nor does the device or method require an attachment to a shoe or a visual projection on any surface. The alignment device provides for real-time measurement of positions and orientations useful in improving a user's stance, feet positioning and golf club positioning and orientation which measurements can be repeated as stance, feet positioning and golf club positioning and orientation are adjusted by the user. A user can adjust or readjust stance and positioning with intervening measurements with the alignment device as needed to improve stance and/or positioning with respect to a given target.

In an embodiment, the alignment device measures the position of each of a user's feet (normally in shoes) relative to the device. In an embodiment, the device measures the position and/or orientation of each of the user's shoes with respect to each other. In an embodiment, the alignment device is selectively oriented with respect to a selected target to which the user intends to hit a golf ball using a target orientation device so that the target orientation device is oriented in the direction of the target. In an embodiment, the alignment device employs an optical method to measure the position of each of a user's feet relative to the device. In an embodiment, the alignment device includes memory for storage of the position of each of the user's shoes relative to the device. In an embodiment, the alignment device includes a processor for determining the aim of the user with respect to the selected target, as determined by the position of the user's shoes with respect to the target-oriented device. In embodiments, the position of the user's shoes with respect to the device is the position of one or more user-defined points on each of the user's shoes with respect to the device. In embodiments, the device includes a display of the position of the user's shoes with respect to the device and/or with respect to the selected target. In embodiments, the position of the alignment device with respect to any other measured distance or orientation is with respect to one or more user-defined points on the alignment device.

In an embodiment, the alignment device also measures the position of a selectively-positioned golf ball relative to the device. In embodiments, the golf ball is positioned by the user for hitting the ball to a selected target. In an embodiment, the device is selectively oriented with respect to a selected target using a target orientation device so that the target orientation device is oriented in the direction of the target. In an embodiment, the alignment device employs an optical method to determine the position of the selectively-positioned golf ball relative to the device and/or relative to the user's shoes. In an embodiment, the alignment device includes memory for storage of the position of the positioned golf ball relative to the device and/or relative to the user's shoes. In an embodiment, the alignment device includes a processor for determining the position of the golf ball relative to the device and/or relative to the user's shoes. In embodiments, the device includes a display of the position of the golf ball relative to the device and/or relative to the user's shoes. In embodiments, the position of the golf ball with respect to the device is the position of one or more selected or user-defined points on the golf ball with respect to the device. In an embodiment, the one or more selected or user-defined points on the golf ball is the center point of the golf ball.

In an embodiment, the alignment device measures the position and orientation of the club head of a golf club being held by the user relative to the device, as the user assumes a position for hitting the selectively-positioned golf ball. In an embodiment, the device is selectively oriented with respect to a selected target using a target orientation device so that the target orientation device is oriented in the direction of the target. In an embodiment, the alignment device employs an optical method to determine the position and orientation of the club head of the golf club being held by the user relative to the device as the user assumes a position holding the golf club for hitting the golf ball. In an embodiment, the alignment device includes memory for storage of the position and orientation of the club head being held by the user relative to the device, and/or with respect to the user's shoes and/or with respect to the positioned golf ball. In an embodiment, the alignment device includes a processor for determining the position and orientation of the club head of the golf club relative to the device and/or relative to the golf ball and/or relative to the user's shoes. In embodiments, the device includes a display for the position and orientation of the club head of the golf club being held by the user relative to the device, and/or relative to the user's shoes and/or relative to the position of the golf ball. In embodiments, the position and orientation of the club head with respect to the device is the position of two or more selected points on the club head with respect to the device. The two or more selected points on the club head can be any two points on the club head and may be pre-selected or user-selected.

In embodiments, the device measures the distance and angle from the device to multiple points on one or both of the user's shoes when the user is positioned to hit the selectively positioned golf ball to the selected target. In embodiments, the device measures the distance and angle from the device to multiple points on the golf ball intended to be struck by the user. In embodiments, the device measures the distance and angle from the device to multiple points on the club face of the golf club being held by the user in position for hitting the golf ball to the selected target. In embodiments, the device measures the distance and angle from the device to multiple points on the club head of the golf club being held by the user in position for hitting the golf ball to the selected target.

In an embodiment, the alignment device determines and identifies the outline of the user's shoes. In an embodiment, the device identifies the outline of the golf ball intended to be stuck by the user. In an embodiment, the device identifies the outline of the club head of the golf club being held by the user. In an embodiment, the device identifies the outline of the club face of the golf club being held by the user. In an embodiment, the alignment device includes memory for storage of the outline of the user's shoes, and/or the outline of the selectively positioned golf ball, and/or the outline of the club face of the golf club being held by the user, and/or the outline of the club head of the golf club being held by the user. In an embodiment, the alignment device includes a display for the outline of the user's shoes, and/or the outline of the selectively positioned golf ball, and/or the outline of the club face of the golf club being held by the user, and/or the outline of the club head of the golf club being held by the user.

In an embodiment, the alignment device comprises a target orientation device to align the device's physical orientation to a desired target. Typically, the alignment device is oriented towards the target, but optionally can be oriented at a selected angle with respect to the target. In an embodiment, the alignment device includes memory for storage of the direction (angle) of alignment of the device with respect to the selected target. In an embodiment, the alignment device determines the angle of the aim of the user with respect to the angle of alignment of the device with respect to the selected target. In an embodiment, the alignment device determines the angle of the club face of the golf club being held by the user with respect to the angle of alignment of the device with respect to the selected target. In embodiments, the alignment device includes a data entry device and memory for entry and storage of user entered values with respect to any useful entered data, for example, user entered data with respect to the angle of aim and/or the orientation of the device with respect to the selected target. In embodiments, the alignment device includes a display to illustrate comparison of the angle of the aim of the user to the orientation of the device with respect to the selected target and/or with respect to user entered values as well as comparison of the angle of the club face of the golf club being held by the user to the orientation of the device with respect to the selected target and/or with respect to user entered values.

In embodiments, the alignment device compares any measured position or orientation data, for example, with respect to each of a user's shoes, a positioned golf ball, a club head of a golf club held in position by a user, the user's aim towards a selected target to user entered values. More specifically, the device compares the measured position of each of the user's shoes and/or the measured position of the golf ball and/or the measured position and orientation of the club head of the golf club being held by the user to user entered values. In embodiments, the device provides a display to illustrate the comparison of measured positions and orientations with respect to user entered data for positions and orientations.

In embodiments, the alignment device uses emitted/reflected/sensed light to measure the position and/or orientation of the user's shoes with respect to the device and/or to measure the position of a golf ball with respect to the device and/or to measure the position and/or orientation of a golf club head with respect to the device and/or to measure the position and/or orientation of a golf club face with respect to the device. In embodiments, the device uses comparison among two or more images acquired to determine the position and/or orientation of the user's shoes with respect to the device, and/or to determine the position of a golf ball with respect to the device, and/or to determine the position and/or orientation of a golf club head with respect to the device, and/or to determine the position and/or orientation of a golf club face with respect to the device. In embodiments, the alignment device comprises memory to store one or more acquired images or one or more user defined reference images. In embodiments, the alignment device comprises a processor for comparison of two or more acquired images or for comparison of one or more acquired images to one or more user defined reference images. In embodiments, the alignment device comprises display for illustrating a comparison of any two or more images. In embodiments the alignment, device uses emitted/reflected/sensed ultrasonic sound to measure the position and/or orientation of the user's shoes with respect to the device, and/or to measure the position of a golf ball with respect to the device, and/or measure the position and/or orientation of a golf club head with respect to the device, and/or measure the position and/or orientation of a golf club face with respect to the device.

In embodiments, the disclosure includes an alignment device for measuring the position and/or orientation of a user's shoes, the position of a golf ball intended to be struck by the user, and the position and/or orientation of a golf club head and face of a golf club held by the user and intended to be used by the user to strike the golf ball with respect to a selected target, the device comprising an target orientation component for aligning the device with respect to a selected target, a distance and/or orientation (angle) measurement component, memory for storage of measured distances and/or orientations or other information related to distance or orientation (angle) and/or for storage of user defined values, a processor for calculations or comparisons as described herein, and a signal system and/or display for any output of a calculation or comparison as described herein. In embodiments, the alignment device measures positions and orientations with respect to its (the alignment device's) position and orientation with respect to the selected target. In embodiments, the device can be used to measure relative positions of the user's shoes, the golf ball, the golf club face and/or the golf club head with respect to each other and the alignment device and/or the selected target.

In an embodiment, the measurement component includes an optical emission component for emitting light towards the user's shoes, golf ball and golf club head and an optical receiver for receiving light which is reflected from the user's shoes, golf ball, golf club face and golf club head. In an embodiment, the measurement component acquires images of the user's shoes, the golf ball, golf club face and/or golf club head. In embodiments, the measurement component is one or more cameras.

In embodiments, the measurement component includes an ultrasonic emission component for emitting ultrasonic soundwaves towards the user's shoes, golf ball, golf club face and golf club head and an ultrasonic receiver for receiving ultrasonic sound waves which is reflected from the user's shoes, golf ball, golf club face, and/or golf club head.

In embodiments, the alignment device includes a processor for operating the measurement component and converting the measurements from the measurement component into distance and/or orientation values from the measurement component to the golfer's shoes, golf ball, golf club face, and/or golf club head. In embodiments, the processor is also used to process the data from the measurement component in order to identify the position and/or orientation and/or outline of the golfer's shoes, the golf ball, golf club face, and/or the golf club head. In embodiments, the processor is used to calculate the position and orientation of the golfer's shoes, golf ball, golf club face, and/or golf club head relative to the alignment device, a selected target, and with respect to each other. In embodiments, the processor is used to compare the positions and orientations of the golfer's shoes, the golf ball, golf club face, and/or the golf club head to user determined values. In embodiments, the processor is used to operate a visual and/or audio display or indicator.

In embodiments, the alignment device includes a visual display or visual or audio indicator used for displaying data measured and/or calculated by the processor, saved by the memory, and/or entered by the user. In embodiments, the alignment device includes a visual display. In embodiments, the alignment device includes a visual display for images entered or acquired. In embodiments, the alignment device includes a speaker for emitting signals and/or audio representations of the data measured and/or calculated by the processor, saved by the memory, and/or entered by the user.

In embodiments, the alignment device includes a transmitter for transmitting data measured and/calculated by the processor, saved by the memory, and/or entered by the user to a signaling device or display that is separate from the alignment device itself. The alignment device may, for example, transmit data to a separate computer system, for example, a laptop or tablet computer or a cell phone or other communication device for display or signaling.

In embodiments, a measurement by the alignment device can be triggered by a switch. In embodiments, the triggering of a measurement can be by activating a remote device which transmits a signal to the alignment device.

The disclosure also provides a method for determining the position of a user's shoes (particularly, the position and orientation of each shoe with respect to the other shoe), the golf ball intended to be struck by the user, and the club head and club face of a golf club intended to be used by the user to strike the golf ball with respect to a selected target employing an alignment device as described herein.

Other aspects and embodiments of the disclosure will be apparent on review of the following description and figures.

DETAILED DESCRIPTION OF THE DISCLOSURE

The disclosure relates to an alignment device and a method for its use to measure the position of both of a user's shoes with respect to the device and assist the user in adapting a stance that is appropriate for a given application. More specifically, the alignment device is adapted for application to hitting a golf ball to a selected target. A device for this application is illustrated in FIG. 1.

Figure 1:
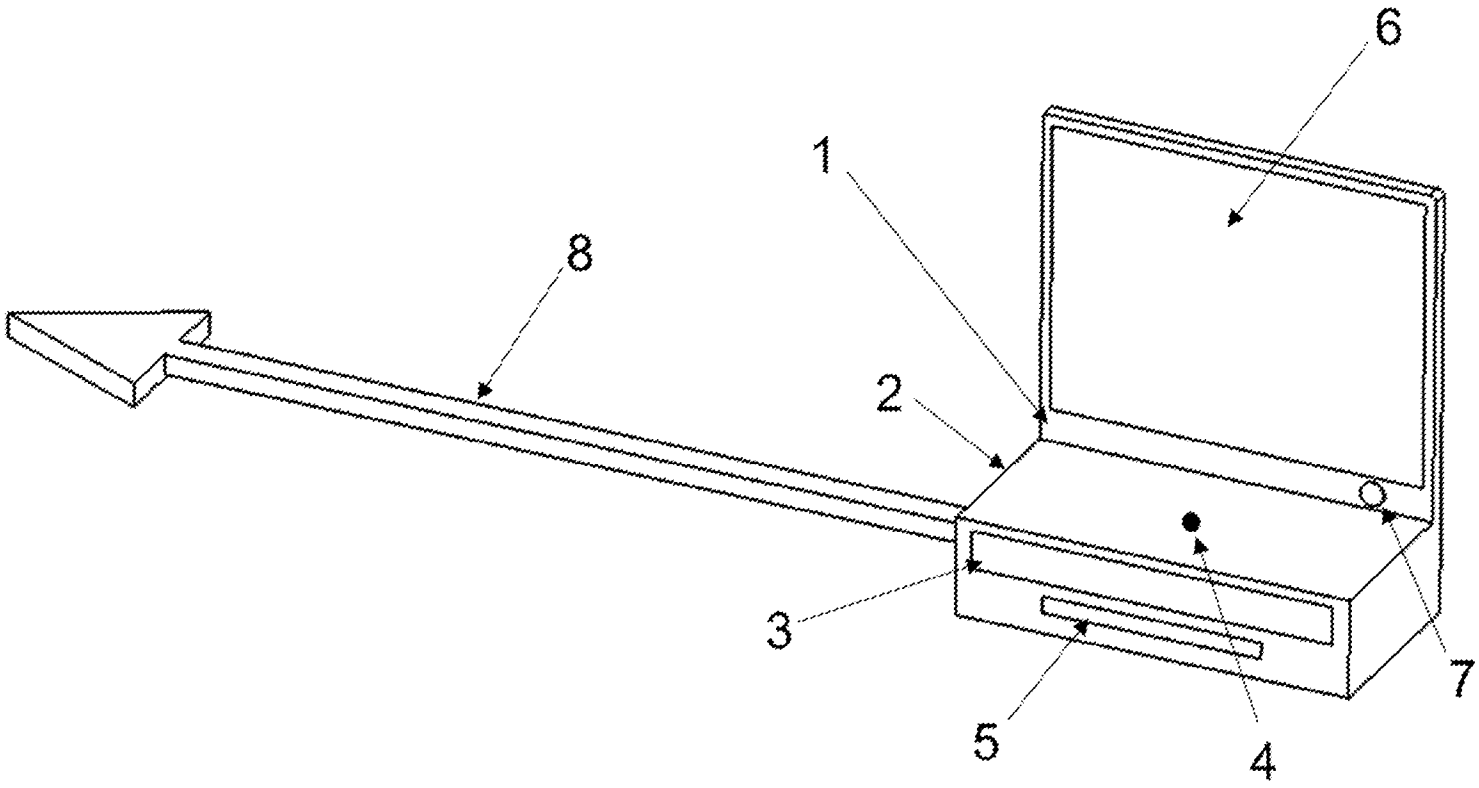
FIG. 1 is a schematic diagram, not necessarily drawn to scale, of an exemplary alignment device (1) with the components of the device identified. These components are the housing enclosure (2), measurement component (3) device center point (4), processor and memory unit (5), display screen (6), speaker (7), and target orientation device (8). The device center point (4) is located at the center of the optical device.
Figure 3:
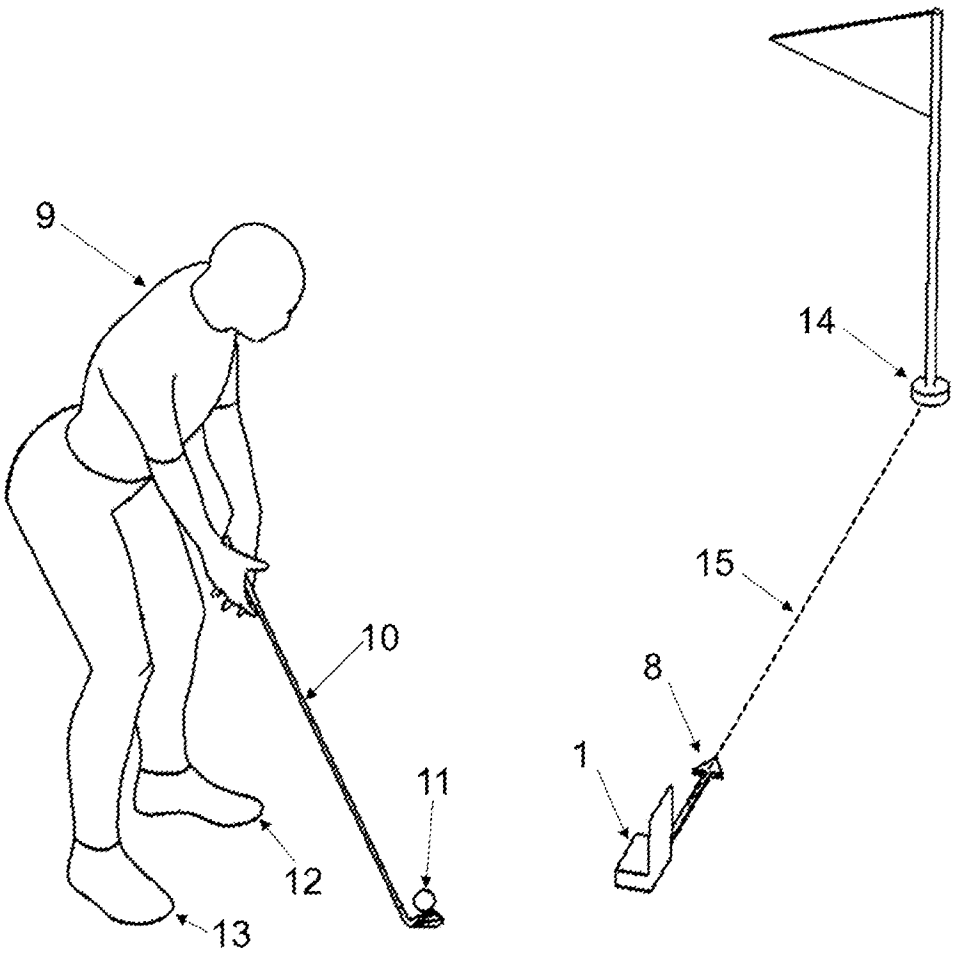
FIG. 3 is a schematic diagram of the user (9) holding a golf club (10) addressing a golf ball (11) and the position of the user's left shoe (12) and user's right shoe (13) with respect to the alignment device (1), not necessarily drawn to scale. The alignment device is pointed towards the target (14) using the target orientation device (8). The device line (15) direction is determined by the device orientation and it is co-linear with the orientation of the target orientation device.

FIG. 1 illustrates an exemplary alignment device (1) with the components of the device identified. These components are the housing enclosure (2), measurement component (3) device center point (4), one or more processor and memory units (5), display screen (6), speaker (7), and target orientation device (8). The device center point (4) is located at the center of the optical device. The measurement component is one or more device elements that are used for measurement of the position and/or orientation of both of the user's shoes, and/or a golf ball positioned to be hit toward a selected target, and/or the head of a golf club held by the user to hit the golf ball, and/or the club face of a golf club held by the user to hit the golf ball. The alignment device is oriented in a selected positon with respect to the selected target by alignment of the target orientation device in the direction of the target, for example as shown in FIG. 3. The processor and memory unit may be combined or separate. The illustrated device includes an optional display screen and an optional speaker for audible output to the user. In embodiments, some form of output is provided, but a specific visual or audible signal or display may be remote from the alignment device itself. The alignment device is optionally provided with a transmitter to transmit some or all measured, calculated or entered data to a remote display or signaling device.

Figure 4:
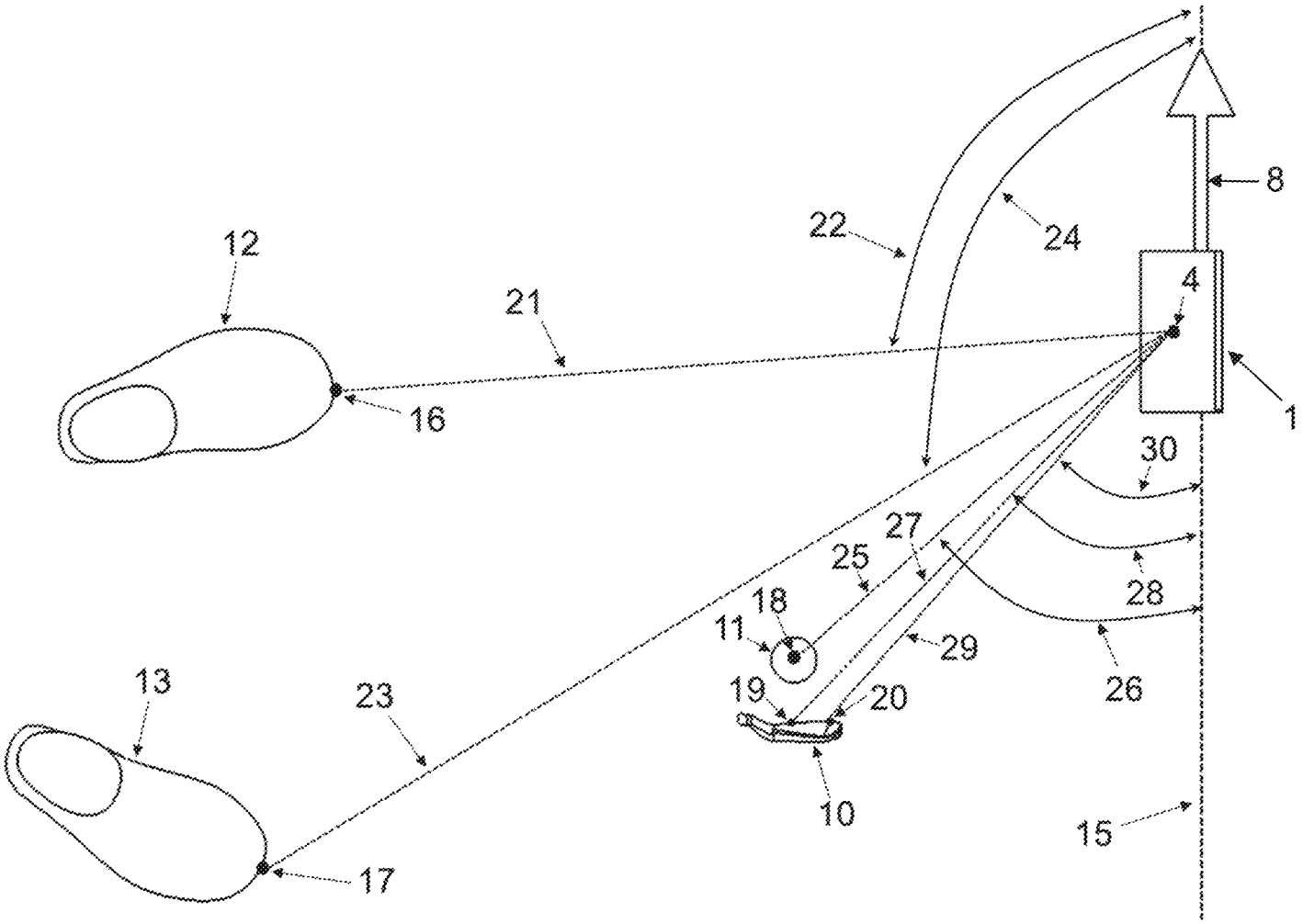
FIG. 4 is schematic diagram of the user's left shoe (12), user's right shoe (13), left foot point (16), right foot point (17), golf ball (11), ball center point (18), golf club (10), club face point 1 (19) and club face point 2 (20) in relation to the alignment device center point (4) and the device line (15). The location of the left foot point is determined by the location of the left shoe and user input. The left foot point is located along the outline of the left shoe in a location determined by the user. The right foot point is determined in the same manner as the left foot point is using the right shoe outline and is thus determined by the location of the right shoe and user input. The ball center point (18) is located in the center of the golf ball. The location of the club face point 1 and club face point 2 are described in FIG. 7. The left foot point line (21) intersects the left foot point and the device center point (4). The left foot point angle (22) is determined by the angle between the left foot point line and the device line (15). The right foot point line (23) intersects the right foot point and the device center point. The right foot point angle (24) is determined by the angle between the right foot point line and the device line. The ball center point line (25) intersects the ball center point and the device center point. The ball center point angle (26) is determined by the angle between the ball center point line and the device line. The club face point 1 line (27) intersects the club face point 1 and the device center point. The club face point 1 angle (28) is determined by the angle between the club face point 1 line and the device line. The club face point 2 line (29) intersects the club face point 2 and the device center point. The club face point 2 angle (30) is determined by the angle between the club face point 2 line and the device line.

FIG. 4 is schematic diagram of the user's left shoe (12), user's right shoe (13), left foot point (1), right foot point (2), golf ball (11), ball center point (3), golf club (10), club face point 1 (4) and club face point 2 (5) in relation to the alignment device center point (4) and the device line (15). The location of the left foot point is determined by the location of the left shoe and user input. The left foot point is located along the outline of the left shoe in a location determined by the user. The right foot point is determined in the same manner as the left foot point is using the right shoe outline and is thus determined by the location of the right shoe and user input. The ball center point (18) is located in the center of the golf ball. The location of the club face point 1 and club face point 2 are described in FIG. 7. The left foot point line (6) intersects the left foot point and the device center point (4). The left foot point angle (7) is determined by the angle between the left foot point line and the device line (15). The right foot point line (8) intersects the right foot point and the device center point. The right foot point angle (9) is determined by the angle between the right foot point line and the device line. The ball center point line (10) intersects the ball center point and the device center point. The ball center point angle (11) is determined by the angle between the ball center point line and the device line. The club face point 1 line (12) intersects the club face point 1 and the device center point. The club face point 1 angle (13) is determined by the angle between the club face point 1 line and the device line. The club face point 2 line (14) intersects the club face point 2 and the device center point. The club face point 2 angle (15) is determined by the angle between the club face point 2 line and the device line.

Figure 5:
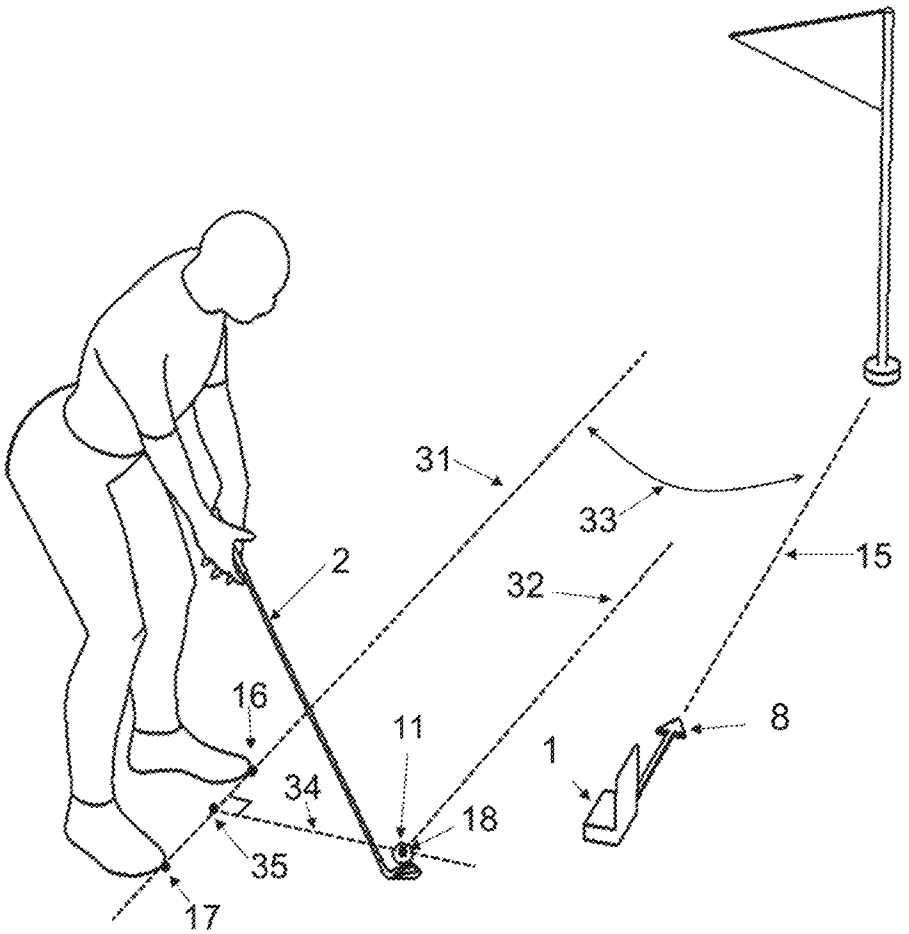
FIG. 5 is a schematic diagram of the stance line (31), aim line (32), and stance angle (33) not necessarily drawn to scale. The stance line is defined by a line drawn through the left foot point (16) and the right foot point (17). The aim line (32) is then determined by the orientation of the stance line (31) and the location of the ball center point (18). The aim line (32) intersects the ball center point (18) and is parallel to the stance line (31). The stance angle (33) is determined by the angle between the device line (15) and the stance line (31). Because the aim line (32) is parallel to the stance line (31), the stance angle (33) is equivalent to the angle between the aim line (32) and the device line (15). The ball line (34) is determined by the ball center point (18) and the stance line (31). The ball line intersects the ball center point and is perpendicular to the stance line. The point of intersection between the ball line and the stance line is the ball stance point (35).

FIG. 5 is a schematic diagram of the stance line (16), aim line (17), and stance angle (18) not necessarily drawn to scale. The stance line is defined by a line drawn through the left foot point (16) and the right foot point (17). The aim line (32) is then determined by the orientation of the stance line (31) and the location of the ball center point (18). The aim line (32) intersects the ball center point (18) and is parallel to the stance line (31). The stance angle (33) is determined by the angle between the device line (15) and the stance line (31). Because the aim line (32) is parallel to the stance line (31), the stance angle (33) is equivalent to the angle between the aim line (32) and the device line (15). The ball line (19) is determined by the ball center point (18) and the stance line (31). The ball line intersects the ball center point and is perpendicular to the stance line. The point of intersection between the ball line and the stance line is the ball stance point (20).

Figure 6:
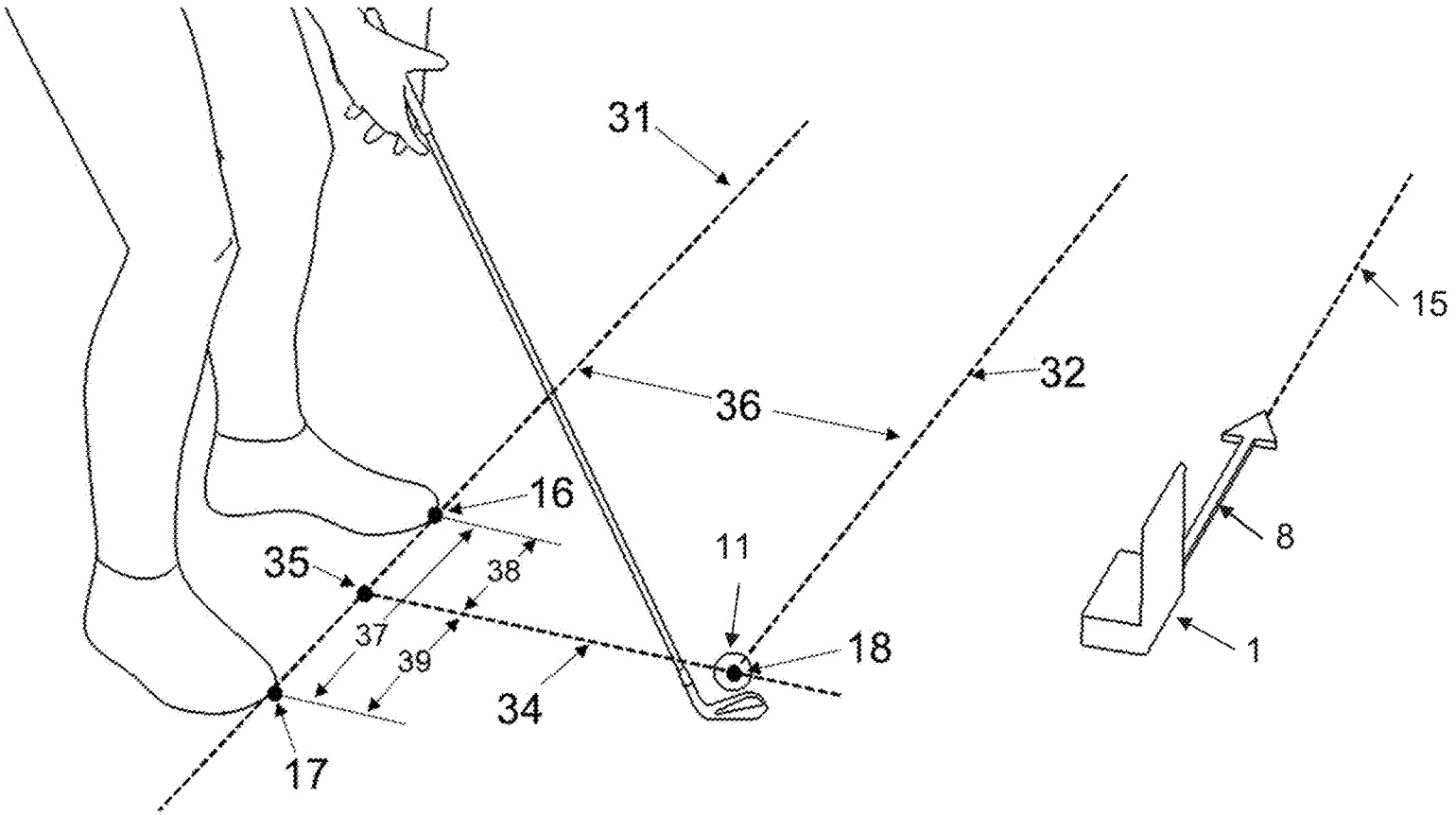
FIG. 6 is a schematic diagram of the ball distance (36), the stance distance (37), the left stance distance (38), and the right stance distance (39), not necessarily to scale. The ball distance is the distance from the ball center point (18) to the ball stance point (35). The stance distance is the distance from the left foot point (16) to the right foot point (17). The left stance distance (38) is the distance from the left foot point (16) to the ball stance point (35). The right stance distance (39) is the distance from the right foot point (17) to the ball stance point (35).

FIG. 6 is a schematic diagram of the ball distance (21), the stance distance (22), the left stance distance (23), and the right stance distance (24), not necessarily to scale. The ball distance is the distance from the ball center point (18) to the ball stance point (35). The stance distance is the distance from the left foot point (16) to the right foot point (17). The left stance distance (38) is the distance from the left foot point (16) to the ball stance point (35). The right stance distance (39) is the distance from the right foot point (17) to the ball stance point (35).

Figure 7:
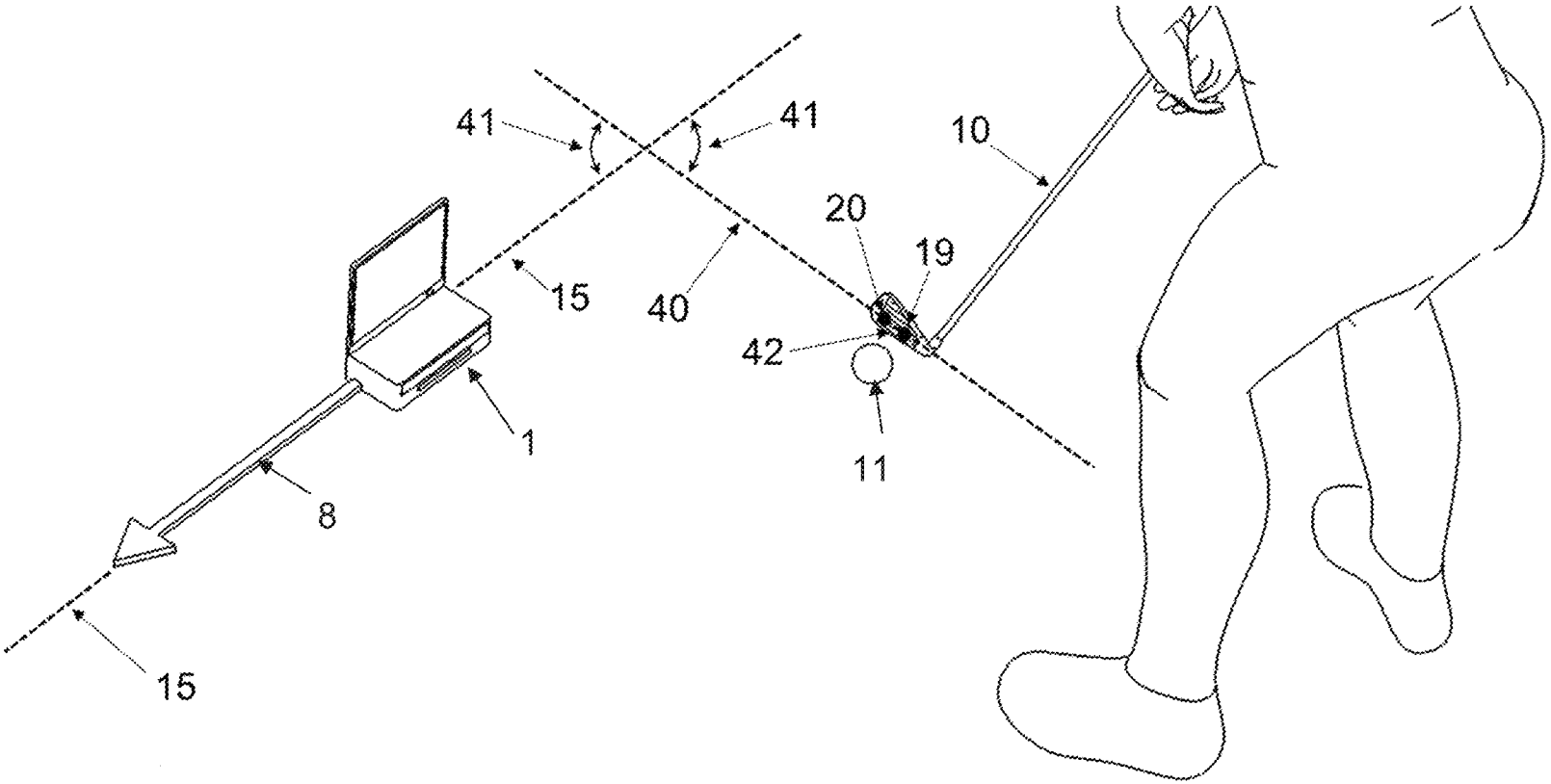
FIG. 7 is a schematic diagram of the club face line (40) and the club face angle (41). The club face line is determined by the location of club face point 1 (19) and club face point 2 (20). The club face line intersects club face point 1 and club face point 2. Club face point 1 and club face point 2 are located on the club face (42) of the golf club (10). The golf club face is located on the golf club, specifically the golf club head. The golf club face is flat face of the golf club head which is intended to make contact with the golf ball. Club face point 1 and club points 2 can be located on anywhere on the plane of this surface as long as they are not the same point and they have the same vertical distance from the ground as one another, causing the club face line to be parallel with the ground as well as the club face. The club face angle (41) is determined by the angle between the club face line and the device line (15) previously described.

FIG. 7 is a schematic diagram of the club face line (25) and the club face angle (26). The club face line is determined by the location of club face point 1 (19) and club face point 2 (20). The club face line intersects club face point 1 and club face point 2. Club face point 1 and club face point 2 are located on the club face (27) of the golf club (10). The golf club face is located on the golf club, specifically the golf club head. The golf club face is flat face of the golf club head which is intended to make contact with the golf ball. Club face point 1 and club points 2 can be located on anywhere on the plane of this surface as long as they are not the same point and they have the same vertical distance from the ground as one another, causing the club face line to be parallel with the ground as well as the club face. The club face angle (41) is determined by the angle between the club face line and the device line (15) previously described.

Any device that allows for measurement of the position and/or orientation of the user's shoes, the golf ball, the golf club face, and/or the golf club head can be used, but the measurement component is preferably an optical or ultrasonic device. The optical measurement device includes a light source for emitting light toward the user's shoes, golf ball, golf club face, and/or golf club head and a light detector for detecting light reflected from the user's shoes, golf ball, golf club face and/or golf club head. Any means for detecting light can be employed. Detection of light includes detection of light of any selected wavelength/frequency. A given light detector may be adjusted to receive and detect light of a selected wavelength. Detection of light optionally includes detection of the intensity of light. Light of a selected frequency/wavelength or range of frequencies/wavelengths may be used. An alternative optical device for measurement comprises two or more separately positioned devices for acquiring images, such as two or more cameras oriented with respect to each other to acquire different images of the user's shoes, and/or golf ball and/or golf club head. Comparison of the different images allows the determination of the relative positions of the user's shoes, golf ball, golf club face, and/or golf club head with respect to the device. An ultrasonic measurement component includes an ultrasonic source for emitting ultrasonic sound waves toward the user's shoes, golf ball, golf club face, and/or golf club head and an ultrasonic detector for detecting ultrasonic soundwaves reflected from the user's shoes, golf ball, golf club face, and/or golf club head.

In specific embodiments, the optical measurement component is a LIDAR system or sensor (laser imaging detection and ranging) which emits laser light and measures the time it takes for light to reflect off of objects. The method of measuring distance by measuring the time it takes for light to reflect off of objects is known as time of flight (TOF). A LIDAR system can be used for 3 D image generation. In a preferred embodiment, a solid state LIDAR sensor is employed to avoid moving parts. Various LIDAR sensor systems are commercially available for use in the alignment device herein. For example, LIDAR sensors available from Velodyne Lidar can be employed in the alignment devices herein. In embodiments, LIDAR cameras can be employed as the optical measurement component in the devices herein. These camera systems combine a time of flight method with digital camera. Such systems take images of scene and generates depth data for each pixel with a LIDAR scanner. For example, a LIDAR camera such as that produced by Intel (RealSense™ LIDAR Camera) can be used as the optical measurement component of the alignment device. In embodiments, the optical measurement component is a laser range scanner which utilizes a laser triangulation method by emitting light to reflect off of an object and measures the location on a sensor where light is detected. The location on the sensor corresponds to a distance between the sensor and the object that the light reflected off of. Such a system is useful in particular for generating 1-D and 2-D data. For example, laser range scanners produced by SLAMTEC are useful in the alignment device herein. In embodiments, depth cameras, which are similar to "machine vision," and utilize a two camera method and/or emit a geometrical light pattern on objects to generate depth pattern can be employed as the optical measurement component in the devices herein. Such cameras combine depth data with digital images. For example, depth cameras such as those produced by Intel RealSense™ can be used as the optical measurement component of the alignment device herein.

Preferably a target orienting device is provided for orienting the device with respect to the selected target. The target orienting device is exemplified by an extendable telescoping rod that is mounted to the top of the alignment device. The telescoping rod can extend so the user can point the device at the target and then retract when oriented correctly. The target orienting device is also exemplified by a foldable rod which is mounted to side of the device. The rod is folded out into its extended position so the user can point the device at the target and then can be folded back against the alignment device when oriented correctly. In a specific embodiment, the alignment device includes a rangefinder that can be pointed at the selected target to measure the distance between the alignment device and the target. In an embodiment, this distance can be transmitted to the alignment device to determine the location coordinates of the target as determined by the orientation of the alignment device and the distance between the alignment device and the target. In another specific embodiment, the alignment device includes a rangefinder that can be pointed at the selected target to measure location coordinates. In an embodiment, coordinates of the selected target can be transmitted to the alignment device and in this case, the device would not have to be physically aligned to the target.

One or more processors are provided generally for operating the measurement component and converting the measurements from the measurement component into distance values. One or more processors are provided to process the data from the measurement component in order to identify the golfer's shoes, the golf ball, and the golf club. One or more processors are provided to calculate the position and orientation of the golfer's shoes, golf ball, golf club face, and golf club head relative to the device, the target, and each other. One or more processors are provided to calculate the specific values needed to define the position and orientation of the golfer's shoes, golf ball, golf club face, and golf club head, for example as defined in calculations provided herein. One or more processors are used to compare the positions and orientations of the golfer's shoes, golf ball, golf club face, and golf club head to user determined values. One or more processors are used to operate a visual and audio display indicator. One or more processors may be included in the measurement component or in the visual or audio display.

One or more memory units are provided for saving data produced by the measurement component and processor as well as entered by the user. One or more memory units may be included in the measurement component or in the visual or audio display.

The alignment device is optionally provided with a visual display indicator used for displaying data calculated by the one or more processors, saved by the one or more memory units, and/or entered by the user. The alignment device is optionally provided with a speaker used for emitting signals and audio representations of the data calculated by the one or more processors, saved by one or more memory units, and/or entered by the user.

The alignment device is optionally provided with a data entry device. For example, data entry can be provided by an alphanumeric or a numeric keyboard or for more limited data entry a set of buttons or switches can be provided. As an alternative data can be transmitted to the alignment device from a remote data entry device, such as a computer or a cell phone.

The alignment device can be provided with a housing enclosure to contain the measurement component, any needed processors, any needed memory units and some form of data output to alert or inform the user of data provided by the alignment device. The housing enclosure optionally contains the target orientation device. Such form of data output can be a visual or audio display such as a speaker. The output can simply be one or more sounds that is emitted when a desired stance or foot position and/or orientation is achieved by the user and/or when a desired position and/or orientation of the golf club head being held by the user is achieved. The housing enclosure is designed to package the measurement component, any processors, any memory units, and any visual or audible display and protect them from physical as well as light damage. In an embodiment, the target orientation device is optionally mounted on the housing or within the housing.

The approach outlined herein uses an optical or ultrasonic distance measurement method to measure the position of both of the user's shoes with respect to the device. The user defines a location on the outside edge of each of their shoes which they would like to define their stance line. This location is usually the longitudinal end of each shoe outline unless another location is specified by the user. The series of points which define the outside edge of the left and right shoe of the user is detected by the device and identified according to the method outlined below.

Method 1: Shoe Outline Identification Method

Figure 2A:
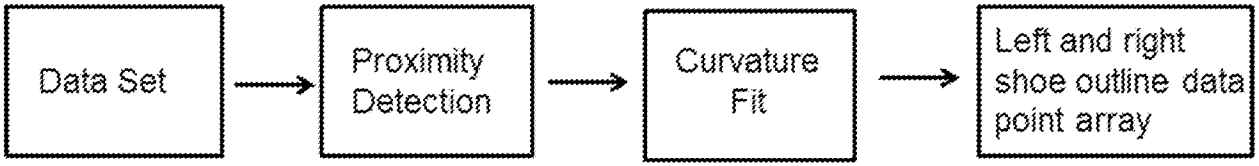
FIGS. 2A-2C are exemplary flow charts for methods employed in the invention.

FIG. 2A provides a flow chart of Method 1 for identification of the shoe outline. A data set is collected, proximity detection is performed and a curvature fit is performed to determine the outline of the left and right shoes. Once the set of data points determined to be the outline of the left and right shoe is identified, the left foot point and right foot point are identified according to the location defined by the user. The device can measure the position of the left foot point and the right foot point to within 5 millimeters, more preferably 2 millimeters and more preferably to one millimeter or less. The line that intersects the left foot point and the right foot point is defined as the stance line. The orientation of the device determines a second line defined as the device line. The angle between the stance line and the device line is defined as the stance angle. The device calculates the stance angle to within 2 degrees, more preferable to one degree, and more preferably to 0.5 degree or less. The measurement component of the device produces angle and distance values, or polar coordinates, of the left foot point and right foot point which can be translated into x and y coordinates on a coordinate system that is determined by the orientation of the device. The coordinates of the left foot point are (X1, Y1) and the coordinates of the right foot point are (X2, Y2). The device calculates the stance angle, SA1, using the formula below.

Stance Angle Equation — Equation 1

$$SA1 = \tan^{-1}\left(\frac{|X1 - X2|}{|Y1 - Y2|}\right)$$

The device can also calculate the distance between the user's shoes. The distance between the user's shoes is defined as the distance between the left foot point and the right foot point previously described. This distance is defined as the stance distance, SD1, and is determined using the formula below.

$$SD1=\sqrt{(X1-X2)^2+(Y1-Y2)^2}$$ Equation 2: Stance Distance Equation

The device can also measure the position of the golf ball that is intended to be hit by the user. The series of points which define the outside of the golf ball are detected by the device. They are identified and the center of the golf ball is determined according the method below.

Method 2: Golf Ball and Ball Center Identification Method

Figure 2B:
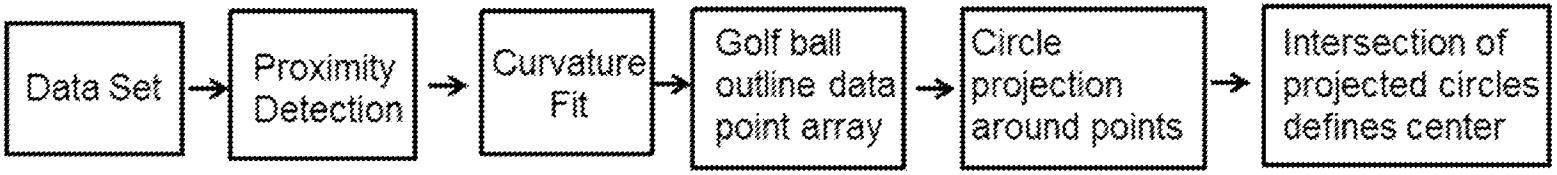

FIG. 2B is a flow chart of the method for golf ball and golf ball center identification. In this method data is collected, proximity detection is performed and curvature fit is performed to identify the golf ball outline. A circle projection is performed using golf ball point array and the intersection of the projected circle defined the center of the golf ball. The center of the golf ball is known as the ball center point and device can calculate the ball center point to within 5 millimeters, more preferably 2 millimeters and more preferably to one millimeter or less. The coordinates of the ball center point are (X3, Y3). A line that is perpendicular to the stance line is projected through the ball center point and this line is defined as the ball line. The point which the ball line intersects the stance line is known as the ball stance point and the X and Y coordinates of the ball stance point are (X4, Y4). The device is capable of calculating these coordinates given the previously measured and calculated coordinates mentioned above. It does this by calculating the distance between the left foot point and the ball center point, known as L1, as well as the distance between the right foot point and the ball center point, known as L2. Given L1 and L2, the angle between L1 and SD1, known as A1, can be calculated and the coordinates of the ball stance point, (X4, Y4), can then be calculated as well. The equations for these variables are given below.

$L1$ Equation — Equation 3

$$L1 = \sqrt{(X3 - X1)^2 + (Y3 - Y1)^2}$$

$L4$ Equation — Equation 4

$$L2 = \sqrt{(X3 - X2)^2 + (Y3 - Y2)^2}$$

$A1$ Equation — Equation 5

$$A1 = \cos^{-1}\left(\frac{L2^2 + SD1^2 - L1^2}{2 * SD1 * L2}\right)$$

Ball Stance Point $X$ Coordinate Equation — Equation 6

$$X4 = X2 + (L2 * \cos(A1) * \sin(SA1))$$

Ball Stance Point $Y$ Coordinate Equation — Equation 7

$$Y4 = Y2 + (L2 * \cos(A1) * \cos(SA1))$$

The distance between the ball stance point and the center of the golf ball is known as the ball distance, BD1. The distance between the ball stance point and the left foot point is defined as the left stance distance, LSD1, and the distance between the ball stance point and the right foot point is defined as the right stance distance, RSD1. The device is capable of calculating the ball distance, the left stance distance, and the right stance distance to within 5 millimeters, more preferably 2 millimeters and more preferably to one millimeter or less using the formulas below.

$$BD1=L2*\sin(A1) \quad \text{Equation 8: Ball Distance Equation}$$

$$RSD1=L2*\cos(A1) \quad \text{Equation 9: Right Stance Distance 1 Equation}$$

$$LSD1=SD1-RSD1 \quad \text{Equation 10: Left Stance Distance 1 Equation}$$

The device can also measure the position relative to the device of at least two points on the club face of the head of the golf club being held by the user. The club face of the head of golf club being held by the user is the surface of the golf club that is intended to make contact with the golf ball. The series of points which define the club face are detected and identified by the device according to the method outlined below.

Method 3: Club Face Identification Method

Figure 2C:
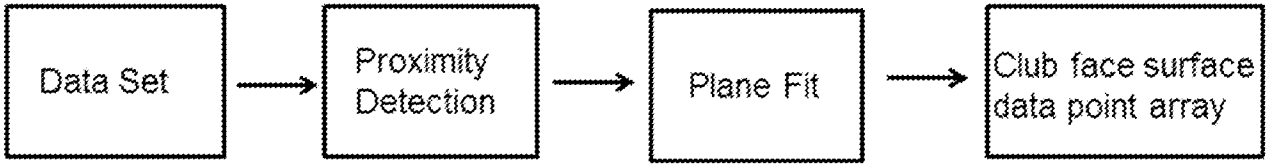

FIG. 2C is a flow chart of the method to identify the golf club surface. A data set is collected and proximity detection is performed and a plane fit is performed to provide a club surface data point array. Two of the points on the club face surface data point array are selected and they are known as club face point 1 and club face point 2. The two points are chosen according to the criteria that they have different X and Y coordinates from one another, and they are both located on the club face surface data point array. The device can measure the location of these points to within 5 millimeters, more preferably 2 millimeters, and more preferably to one millimeter or less. The measurement component of the device produces angle and distance values, or polar coordinates, of the club face point 1 and club face point 2 which can be translated into x and y coordinates.

The x and y coordinates of two of these points are (X5, Y5) and (X6, Y6) respectively. The line that intersects club face point 1 and club face point 2 is determined and defined as the club face line. If this line is not parallel to the ground, then it is projected to form a line directly beneath it that is parallel to the ground, and this projected line becomes the club face line. The angle between the club face line and the line which is orthogonal to the device line is defined as the club face angle. The device can calculate the club angle, CFA1, to within 2 degrees, more preferably one degree and more preferably to 0.5 degree or less. The device calculates this angle using the formula below.

Club Face Angle Equation — Equation 11

$$CFA1 = \tan^{-1}\left(\frac{|Y6-Y5|}{|X6-X5|}\right)$$

Any technique that allows for the measurement of the previously mentioned items can be employed by the device, but the device preferably uses an optical or ultrasonic measurement technique to measure the positions of the previously mentioned items. One example of the optical technique emits light onto the object being measured. The light is then reflected off of the object and is detected by a sensor. The sensor has multiple locations at which the light can contact it and the device is capable of determining at which location the light contacts the sensor. The location that the light contacts the sensor corresponds with the distance between the device and the point of the object which reflected the light. This process is repeated multiple times at varying horizontal and vertical directions or angles from the device and thus detects the position of multiple points of the object as defined by distance and angle, or polar coordinates. The multiple points can define the outside surface and/or edge of the object being measured.

Another example of the optical technique emits pulsating light onto the object being measured at a known frequency. The pulsating light reflects off of the object being measured and is received by a sensor. The device measures the frequency of the light received by the sensor and it measures the time from when the light was emitted to when it was received by the sensor. This time corresponds with the distance between the device and the point of the object which reflected the light. This process is repeated multiple times at varying horizontal and vertical directions or angles from the device and thus detects the position of multiple points of the object as defined by distance and angle, or polar coordinates. The multiple points can define the outside surface and/or edge of the object being measured.

Another example of the optical technique emits light onto the object being measured in a selected geometrical pattern which can vary with time. For example, the light might be emitted in horizontal lines which are a known width and spaced apart at a known distance. This patterned light is reflected off of the object, and the pattern of the light is changed depending on the shape of the object and the distance between the object and the sensor. The sensor detects the changed pattern and is able to determine the distance between the object and sensor according to the difference in the pattern of the projected light.

Another example of the optical technique uses two different cameras to take pictures of the image. The cameras are a known distance apart from each other and have a unique perspective on the object. As a result of the different perspectives, the images of the object are different for each camera, specifically the location of the object being detected within the image is different for each camera. This difference in location of the object with respect to the two cameras can be used to calculate the distance between the sensors and the object. It will be clear to one of ordinary skill in the art that a plurality of cameras, a known distance apart from each other, can be used in this optical technique.

The device preferably uses an optical or ultrasonic measurement technique but can use any measurement technique to measure the position relative to the device of the left foot point, the right foot point, the golf ball, the club face point 1 and the club face point 2. It calculates the stance angle, the stance distance, the ball center point, the ball distance, the ball stance distance 1, the ball stance distance 2, and the club face angle from the measured data using the calculations previously described. The device displays the value of the stance angle, stance width distance, ball distance, ball stance distance 1, ball stance distance 2, and club angle. The value of these variables will update within one second of the user physically changing them by moving his feet, the golf ball or golf club.

The device is placed on the ground within a practically useful distance from either of the user's shoes. The device can be positioned within 30 feet, preferably within 10 feet and more preferably within 5 feet or less from either of the user's feet. The device utilizes a target orientation device to selectively orient the device with respect to the target so that the target orientation device is oriented in the direction towards the target. The orientation of the alignment device, which determines the device line depicted in FIG. 3, determines the coordinate system by which the device measures the position of all objects with respect to itself. One of the axis of the coordinate system is parallel to the device line which is parallel to the orientation of the target orientation device. The locations of all measured objects relative to the device are defined by x and y coordinates on this coordinate system, including the target. The target is located by defining a vector from the alignment device to the target, which can be translated into x and y coordinates. By orientating the target orientation device, the device line and alignment device directly at the target, one of the axis of the defined coordinate system is collinear with the line between the alignment device and the target. This defines the direction of the vector between the alignment device and the target on the alignment devices coordinate system. The distance between the alignment device and the target determines the magnitude of the vector between the alignment device and the target, and thus, the x and y coordinates of the target are defined by the vector between the alignment device and the target. The target orientation device determines the orientation of the device, the direction of the device line, and the x and y coordinate system used for the previously mentioned points.

The distance to the target can optionally be entered, or defined, into the device. If this is done, the device is capable of calculating the exact location of the target according to x and y coordinates. If the exact distance to the target is not entered into the device, then the user can enter an approximate distance to the target into the device and the device can calculate an approximate location of the target according to x and y coordinates. The user can also define values for all the measured and calculated values previously described. The device can compare the value of all of the measured and calculated variables to the values that the user has defined. For example, the device can determine whether the aim line of the user is pointed directly at the location of the target and what the angle between the aim line and the device line is required to be for the aim line to be pointed directly at the target. The device can then compare the measured angle of the user's aim line to the angle required for the aim line to be pointed directly at the target. One of the defined values the user can enter can be an offset to the angle that is required for the aim line to be pointed directly at the target and the device can compare the measured angle of the user's aim line to this offset angle. This offset angle would be used, for example, when the user wants to have his/her aim line pointed to the left or right of the target by a quantifiable angle. This would allow the user to practice hitting golf shots which curve from their aim line towards the target. The device can emit an audio and visual signal when the values of the variables measured and calculated by the device are equal to, greater than, or less than the user defined values.

The invention provides an alignment device that measures the position of each of a user's feet relative to the device wherein the device itself is positioned at a selected known orientation with respect to a selected target. In an embodiment, an optical method is uses an optical method to measure the position of each of the user's feet relative to the device.

In an embodiment, the alignment device provides a display of the aim of the user with respect to the selected target as determined by the position of the user's feet, specifically the position of a user defined point on each of the user's feet.

In an embodiment, the alignment device further measures the position of a golf ball relative to the device. In an embodiment, the device uses an optical method to measure the position of a golf ball relative to the device.

In an embodiment, the device provides a display of the position of the golf ball relative to the device as well as relative to the user's shoes.

In an embodiment, the device measures the position and orientation of the club head of the golf club being held by the user relative to the device. In an embodiment, the device uses an optical method to measure the position and orientation of the club head of the golf club being held by the user relative to the device.

In an embodiment, the device provides a display of the position and orientation of the club head of the golf club being held by the user relative to the device.

In an embodiment, the device measures the position and orientation of the club face of the golf club being held by the user relative to the device. In an embodiment, the device uses an optical method to measure the position and orientation of the club face of the golf club being held by the user relative to the device.

In an embodiment, the device provides a display of the position and orientation of the club face of the golf club being held by the user relative to the device.

In an embodiment, the device measures the distance and angle from the device to multiple points on each of the user's shoes.

In an embodiment, the device measures the distance and angle from the device to multiple points on the golf ball intended to be struck by the user.

In an embodiment, the device measures the distance and angle from the device to multiple points on the club face of the golf club being held by the user.

In an embodiment, the device measures the distance and angle from the device to multiple points on the club head of the golf club being held by the user. In an embodiment, the device uses an optical method to measure the distance and angle from the device to multiple points on each of the user's shoes. In an embodiment, the device uses an optical method to measure the distance and angle from the device to multiple points on the golf ball intended to be struck by the user. In an embodiment, the device uses an optical method to measure the distance and angle from the device to multiple points on the club face of the golf club being held by the user. In an embodiment, the device uses an optical method to measure the distance and angle from the device to multiple points on the club head of the golf club being held by the user.

In an embodiment, the device identifies the outline of the user's shoes. In an embodiment, the device identifies the outline of the golf ball intended to be stuck by the user. In an embodiment, the device identifies the outline of the club head of the golf club being held by the user. In an embodiment, the device identifies the outline of the club face of the golf club being held by the user.

In an embodiment, the device employs a target orientation device to align the device's physical orientation to a desired target.

In an embodiment, the device compares the angle of the aim of the user to the angle of the device's physical orientation. In an embodiment, the device compares the angle of the aim of the user to user entered values. In an embodiment, the device compares the position of a golf ball to user entered values.

In an embodiment, the device compares the position and orientation of the club head of the golf club being held by the user to the user entered values. In an embodiment, the device compares the position and orientation of the club face of the golf club being held by the user to the user entered values.

In an embodiment, the device uses emitted/reflected/sensed light to determine the position of the user's shoes with respect to the device. In an embodiment, the device uses emitted/reflected/sensed light to determine the position of a golf ball with respect to the device. In an embodiment, the device uses emitted/reflected/sensed light to determine the position of the club face of a golf club with respect to the device. In an embodiment, the device uses emitted/reflected/sensed light to determine the position of the club head of a golf club with respect to the device.

In an embodiment, the device uses comparison between two images taken to determine the position of the user's shoes with respect to the device. In an embodiment, the device uses comparison between two images taken to determine the position of a golf ball with respect to the device. In an embodiment, the device uses comparison between two images taken to determine the position of the club face of a golf club with respect to the device. In an embodiment, the device uses comparison between two images taken to determine the position of the club head of a golf club with respect to the device.

In an embodiment, the device uses emitted/reflected/sensed ultrasonic sound to determine to position of the user's shoes with respect to the device. In an embodiment, the device uses emitted/reflected/sensed ultrasonic sound to determine to position of a golf ball with respect to the device. In an embodiment, the device uses emitted/reflected/sensed ultrasonic sound to determine to position of the club face of a golf club with respect to the device. In an embodiment, the device uses emitted/reflected/sensed ultrasonic sound to determine to position of the club head of a golf club with respect to the device.

In embodiments, the device comprises components that allow measurement of the distance from and orientation of a user's shoes, a golf ball, a golf club and/or a golf club face with respect to the device.

In an embodiment, the invention provides an alignment device that measures the position of each of a user's feet relative to the device wherein the device itself is positioned at a selected known orientation with respect to a selected target, and uses an optical method to measure the position of each of the user's feet relative to the device and provides a display of the aim of the user with respect to the selected target as determined by the position of the user's feet, specifically the position of a user defined point on each of the user's feet. In an embodiment, the selected target is a desired position of a golf ball resulting from the user striking a golf club with the swing of a golf club, wherein the device determines the aim of the user with respect to a measured the position of a golf ball relative to the device. In an embodiment, the device provides a display of the position of the golf ball relative to the device as well as relative to the user's shoes. In embodiments, the device measures distances and orientation of shoes, golf ball, golf club, and the position and orientation of the club head of the golf club being held by the user relative to the device with an optical device. In embodiments, the device provides a display of the position and orientation of the club head of the golf club being held by the user relative to the device.

In embodiments, the device measures the distance and angle from the device to multiple points on each of the user's shoes and or measures the distance and angle from the device to multiple points on the golf ball intended to be struck by the user and/or measures the distance and angle from the device to multiple points on the club face of the golf club being held by the user. In embodiments, the device comprises one or more displays of such measurements of distance and angle.

In embodiments, the device identifies the outline of the user's shoes, identifies the outline of the golf ball intended to be stuck by the user and/or identifies the outline of the club head of the golf club being held by the user.

In embodiments, the alignment device, comprises a target orientation device to align the device's physical orientation to the selected target. In embodiments, the device compares the angle of the aim of the user to the orientation of the device with respect to the target. In embodiments, the device compares the angle of the aim of the user, the position of a golf ball, the position and orientation of the club head of a golf club being held by the user, and/or the position and orientation of the club face of the golf club being held by the user to user entered values.

In embodiments emitted/reflected/sensed light or ultrasound is used to determine the position of the user's shoes with respect to the device, the position of a golf ball with respect to the device, the position of the club face of a golf club with respect to the device, and/or the position of the club head of a golf club with respect to the device.

In embodiments, the device comprises components that allow comparison of two or more images. In embodiments, the device allows a comparison between two images is made to determine the position of the user's shoes with respect to the device, the position of a golf ball with respect to the device, the position of the club face of a golf club with respect to the device, the position of the club head of a golf club with respect to the device.

In embodiments, the invention provides a device for determining the position or relative position of a golfer's feet, golf ball intended to be struck by the golfer, club head and club face of a golf club intended to be used by the golfer to strike the golf ball with respect to a target which comprises:

- a measurement component for measuring the position and/or orientation of the golfer's shoes, and/or golf ball, and/or golf club head, and/or golf club face with respect to the device;
- one or more processors for operating the measurement component or other components of the device, and/or converting the measurements from the measurement component into distance values from the device to the golfer's shoes, and/or golf ball, and/or golf club head, and/or golf club face, and/or processing the data from the measurement component in order to identify the golfer's shoes, the golf ball, the golf club head, and the golf club face, and/or calculating the position and orientation of the golfer's shoes, golf ball, golf club head, and golf club face relative to the device, the target, and each other and/or to compare the positions and orientations of the golfer's shoes, golf ball, golf club head, and golf club face to user determined values;
- one or more memory unit for saving data produced by the measurement component and/or the one or more processors as well as any data entered by the user; an output display or indicator for displaying the results of data calculated by the processor, saved by the memory, and/or entered by the user; and a target orientation device used to orient the alignment device with respect to the selected target.

In an embodiment, the invention provides A method for determining the position of a golfer's shoes, golf ball intended to be struck by the golfer, and golf club head and golf club face intended to be used by the golfer to strike the golf ball with respect to a target employing the device(s) recited above.

In an embodiment, the invention provides a method for determining the position of a golfer's feet, a golf ball intended to be struck by the golfer, and a golf club intended to be used by the golfer to strike the golf ball with respect to a target, which comprises the steps of:

(a) the user designating the locations of the left foot point and right foot point along the outline of the left and right foot and saving the locations in device memory; (b) the user optionally entering into device memory desired values for any or all of the variables including the stance angle, stance distance, left stance distance, right stance distance, ball distance, and club face angle;

(c) the user placing the device on the ground within usable range and orienting the device towards the target using the target orientation device, wherein the device is positioned within measurement range of the feet, golf ball and golf club head;

(d) the user addressing the golf ball with their golf club in the position the user intends to hit the golf ball;

(e) activating the device to measure the distance from the device to the golfer's shoes, golf ball and golf club head, wherein the distance is measured by an optical technique and thereby identifying the positions of the users left shoe, right shoe, the golf ball, and the golf club head;

(f) calculating and identifying the location relative to the device of the left foot point, right foot point, ball center point, club face point 1, and club face point 2;

(g) calculating the stance angle, stance distance, left stance distance, right stance distance, ball distance and club face angle;

(h) displaying the calculated values from step (g) on the output display or indicator and optionally emitting the values audibly through the speaker;

(i) optionally comparing the calculated values from step (g), any user entered values from step (b) and alerting the user through one or more visual and/or audio signal if these values are greater than, lesser than, or equal to the user entered values; and (j) the user determining if the feet, the golf ball and the golf club are in the desired positions using the feedback from the device from steps (h) and (i).

In embodiments, the invention provides methods of training a golfer to improve their stance or swing which employs the device and methods as described herein.

In embodiments, the invention provides a method of adjusting a golfer's stance and positioning which comprises determining the position of a golfer's feet, golf ball intended to be struck by the golfer, and golf club intended to be used by the golfer to strike the golf ball with respect to a target by use of the device and methods as described herein. More specifically, the invention provides a method of adjusting a golfer's stance and positioning which comprises determining the position of a golfer's feet, golf ball intended to be struck by the golfer, and golf club intended to be used by the golfer to strike the golf ball with respect to a target and (k) if the user's feet, the golf ball and the golf club head are not in the desired positions, the user readjusting the position(s) of the user's feet, the golf ball and/or the golf club; and (l) repeating steps (d) through (k) above until the user's feet, golf ball and golf club are in the desired positions. In embodiments of this method, wherein once the golfer's feet, the golf ball and the golf club are in the desired positions, the user hits the golf ball and steps (d) through (m) are repeated each time the user strikes a golf ball thereby training the user to properly adjust their stance.

In an embodiment, the invention provides a device for determining the position of a golfer's feet, golf ball intended to be struck by the golfer, club head and club face of a golf club intended to be used by the golfer to strike the golf ball with respect to a target. In embodiments, the device includes a measurement component for measuring the position and/or orientation of the golfer's shoes, and/or golf ball, and/or golf club head, and/or golf club face with respect to the device. In embodiments, the device includes one or more processors for operating the measurement component or other components of the device, and/or for converting the measurements from the measurement component into distance values from the device to the golfer's shoes, and/or golf ball, and/or golf club head, and/or golf club face, and/or for processing the data from the measurement component in order to identify the golfer's shoes, the golf ball, the golf club head, and the golf club face, and/or calculating the position and orientation of the golfer's shoes, golf ball, golf club head, and golf club face relative to the device, the target, and each other and/or to compare the positions and orientations of the golfer's shoes, golf ball, golf club head, and golf club face to user determined value. In embodiments, the device includes one or more memory unit for saving data produced by the measurement component and/or the one or more processors as well as any data entered by the user. In embodiments, the device includes an output display or indicator for displaying the results of data calculated by the processor, saved by the memory, and/or entered by the user; and a target orientation device used to orient the alignment device with respect to the selected target.

In embodiments, the invention provides a method for determining the position of a golfer's shoes, golf ball intended to be struck by the golfer, and golf club head and golf club face intended to be used by the golfer to strike the golf ball with respect to a target employing the device as described herein.

In embodiments, the invention provides a method for determining the position of a golfer's feet, golf ball intended to be struck by the golfer, and golf club intended to be used by the golfer to strike the golf ball with respect to a target employing a device as described herein, and which comprises the steps of: (a) the user designating the locations of the left foot point and right foot point along the outline of the left and right foot and saving the locations in device memory; (b) the user optionally entering into device memory desired values for any or all of the variables including the stance angle, stance distance, left stance distance, right stance distance, ball distance, and club face angle; (c) the user placing the device on the ground within usable range and orienting the device towards the target using the target orientation device, wherein the device is positioned within measurement range of the feet, golf ball and golf club head; (d) the user addressing the golf ball with their golf club in the position the user intends to hit the golf ball; (e) activating the device to measure the distance from the device to the golfer's shoes, golf ball and golf club head, wherein the distance is measured by an optical technique and thereby identifying the positions of the users left shoe, right shoe, the golf ball, and the golf club head; (f) calculating and identifying the location relative to the device of the left foot point, right foot point, ball center point, club face point 1, and club face point 2; (g) calculating the stance angle, stance distance, left stance distance, right stance distance, ball distance and club face angle; (h) displaying the calculated values from step (g) on the output display or indicator and optionally emitting the values audibly through the speaker; (i) optionally comparing the calculated values from step (g), any user entered values from step (b) and alerting the user through one or more visual and/or audio signal if these values are greater than, lesser than, or equal to the user entered values; (j) the user determining if the feet, the golf ball and the golf club are in the desired positions using the feedback from the device from steps (h) and (i).

In an embodiment, the invention provides a method of adjusting a golfer's stance and positioning which comprises determining the position of a golfer's feet, golf ball intended to be struck by the golfer, and golf club intended to be used by the golfer to strike the golf ball with respect to a target by the method detailed above. wherein (k) if the user's feet, the golf ball and the golf club head are not in the desired positions, the user readjusting the position(s) of the user's feet, the golf ball and/or the golf club; and (l) repeating steps (d) through (k) until the user's feet, golf ball and golf club are in the desired positions.

In an embodiment of the forgoing method, wherein (m) once the golfer's feet, the golf ball and the golf club are in the desired positions, the user hits the golf ball and (n) repeating steps (d) through (m) each time the user strikes a golf ball.

The device can optionally provide visual output or other display of any data collected and or calculated by the device. For example, the device can provide a visual representation or other display of:

- the stance angle, stance width distance, ball distance, ball stance distance 1, ball stance distance 2, and club angle as previously defined;
- the aim of the user as determined by the position of the user's feet;
- the position of the user's feet relative to the device as well as relative to each other;
- the position of the golf ball relative to the device as well as relative to the user's feet;
- the position and/or orientation of the club head of the golf club being held by the user relative to the device as well as relative to the user's feet;
- the position and/or orientation of the club face of the golf club being held by the user relative to the device as well as relative to the user's feet;
- the distance and angle from the device to multiple points on each of the user's shoes or to multiple points on the golf ball intended to be struck by the user or to multiple points on the club head of the golf club being held by the user or to multiple points on the club face of the golf club being held by the user;
- the outline of the user's shoes;
- the outline of the golf ball intended to be stuck by the user;
- the outline of the club head of the golf club being held by the user;
- the position and/or orientation of the user's shoes, placed golf ball, club head of the golf club being held by the use, and the club face of the golf club being held by the user with respect to one another; and/or
- the alignment of the device's physical orientation to a desired target.

When any grouping is used herein, all individual members of the group and all combinations and subcombinations possible of the group are intended to be individually included in the disclosure. Every combination of components described or exemplified herein can be used to practice the invention, unless otherwise stated.

One of ordinary skill in the art will appreciate that measurement, calculation and comparison methods, materials and device components or elements other than those specifically exemplified herein can be employed in the practice of the invention without resort to undue experimentation. All art-known functional equivalents of any such methods, materials, device elements or device components are intended to be included in this invention.

Whenever a range is given in the specification, for example, a range of distances, all intermediate ranges and subranges, as well as all individual values included in the ranges given are intended to be included in the disclosure.

The invention illustratively described herein suitably may be practiced in the absence of any element or elements, limitation or limitations which is not specifically disclosed herein.

Without wishing to be bound by any particular theory, there can be discussion herein of beliefs or understandings of underlying principles or mechanisms of action relating to the invention. It is recognized that regardless of the ultimate correctness of any mechanistic explanation or hypothesis, an embodiment of the invention can nonetheless be operative and useful.

All references throughout this application, for example patent documents including issued or granted patents or equivalents; patent application publications; and non-patent literature documents or other source material; are hereby incorporated by reference herein in their entireties, as though individually incorporated by reference. All patents and publications mentioned in the specification are indicative of the levels of skill of those skilled in the art to which the invention pertains. References cited herein are incorporated by reference herein in their entirety to indicate the state of the art, in some cases as of their filing date, and it is intended that this information can be employed herein, if needed, to exclude (for example, to disclaim) specific embodiments that are in the prior art. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

We claim:

1. A golf alignment device for determining the position of each of a golfer's feet in shoes with respect to a target which comprises:

- a housing enclosure;
- a target orientation device mounted on or within the housing enclosure to orient the alignment device with respect to the target;
- a measurement component in the housing enclosure for measuring the position and/or orientation of each of the golfer's shoes with respect to the alignment device;
- one or more processors for operating the measurement component, and/or converting the measurements from the measurement component into distance values from the device to each of the golfer's shoes, and/or processing the data from the measurement component in order to identify each of the golfer's shoes and/or calculating the position and orientation of each of the golfer's shoes relative to the alignment device and to the target;

one or more memory unit for saving data produced by the measurement component and/or the one or more processors; and a visual display or audio indicator for displaying the results of data calculated by the processor, or saved by the memory.

2. The golf alignment device of claim 1, wherein the measuring component comprises an optical source for emitting light toward the golfer's shoes and a light detector for detecting light reflected from the golfer's feet.

3. The golf alignment device of claim 2, wherein the measuring component is a LIDAR (Light Detection and Ranging) system or sensor or a laser range scanner.

4. The golf alignment device of claim 1, wherein the measuring component comprises an ultrasonic source for emitting for emitting ultrasonic sound waves toward the golfer's shoes and an ultrasonic detector for detecting ultrasonic sound waves reflected from the golfer's shoes.

5. The golf alignment device of claim 1, wherein the measuring component comprises two or more separately positioned devices for acquiring images.

6. The golf alignment device of claim 5, wherein the separately positioned devices for capturing images are cameras oriented with respect to each other to acquire different images of the golfer's shoes.

7. The golf alignment device of claim 1, wherein the measuring component comprises a depth camera.

8. The golf alignment device of claim 1 further comprising a rangefinder mounted on the alignment device for measurement of the distance from the alignment device to the target or that can be pointed at the selected target to measure location coordinates.

9. The golf alignment device of claim 1, which comprises a visual display rather than an audio indicator.

10. The golf alignment device of claim 1, which comprises an audio indicator rather than a visual display.

11. The golf alignment device of claim 1, wherein the one or more processors calculate the aim of the golfer with respect to the selected target as determined by the measured position of the golfer's shoes and compare the aim relative to the location of the alignment device relative to the target and the device comprises a visual display or audio indicator of this comparison.

12. The golf alignment device of claim 1, which further determines the position of a golf ball intended to be struck by the golfer, and the face of the head of a golf club held by the golfer and wherein the measurement component is for measuring the position of the golf ball, and/or the golf club head face.

13. A method for determining the position of each of a golfer's feet in shoes with respect to a target, which comprises the steps of:

(a) providing a golf alignment device comprising:

a housing enclosure;

a target orientation device mounted on or within the housing enclosure;

a measurement component in the housing enclosure;

one or more processors for operating the measurement component, and/or converting the measurements from the measurement component into distance values, and/or processing the data from the measurement component;

one or more memory unit for saving data produced by the measurement component and/or the one or more processors; and a visual display or audio indicator for displaying the results of data calculated by the processor, or saved by the memory;

(b) orienting the golf alignment device towards the target using the target orientation device wherein the golf alignment device is positioned within measurement range of each of the golfer's shoes;

(c) the golfer addressing a golf ball holding a golf club with the golfer's shoes positioned to hit the golf ball;

(d) activating the golf alignment device to measure the distance from the device to each of the golfer's shoes, (e) calculating the golfer's aim with respect to the target based on the measured position of each of the golfer's shoes with respect to the oriented golf alignment device;

(f) displaying the calculated aim with respect to the target on the visual display or emitting an audible indicator of the calculated aim with respect to the target.

14. The method of claim 13, further comprising entering one or more defined values into the one or more memory unit of the alignment device; wherein calculating comprises comparing defined values to measured values.

15. The method of claim 13, wherein the golf alignment device is activated to measure the distance from the oriented golf alignment device to each of the golfer's shoes, to a golf ball intended to be struck by the golfer and to the face of the head of a golf club held by the golfer;

and wherein calculating the golfer's aim with respect to the target is based on the measured position of each of the golfer's shoes, the golf ball and the face of the head of the golf club with respect to the oriented golf alignment device.

16. A method of adjusting a golfer's stance and positioning which comprises determining the position of a golfer's shoes, a golf ball intended to be struck by the golfer, and the face of the head of a golf club held by the golfer to strike the golf ball with respect to a target by the method of claim 15;

(g) if the golfer's shoes, the golf ball and the face of the head of the golf club are not in position for the aim of the golf shot to be directed to the target, the golfer readjusting the position(s) of each of the golfer's shoes, the golf ball and/or the face of the head of the golf club; and (h) repeating steps (c) through (f) until the golfer's shoes, golf ball and face of the head of the golf club are in the desired positions for the aim of the golf shot to be directed to the target.

17. The method of claim 6, wherein (i) once the golfer's shoes, the golf ball and the face of the head of the golf club are in the desired positions, the golfer hits the golf ball and (j) repeating steps (c) through (i) each time the golfer strikes the golf ball.

* * * * *